United States Patent [19]

Darilek et al.

[11] Patent Number: 4,950,374

[45] Date of Patent: Aug. 21, 1990

[54] ELECTROPHORETIC LEAK SEALING SYSTEM

[75] Inventors: Glenn T. Darilek; Daren L. Laine, both of San Antonio, Tex.

[73] Assignee: Southwest Research Institute, San Antonio, Tex.

[21] Appl. No.: 311,177

[22] Filed: Feb. 14, 1989

[51] Int. Cl.[5] ..... C25D 13/02; C25D 13/12

[52] U.S. Cl. ..... 204/180.2; 204/16; 204/180.1; 204/180.7; 204/299 R

[58] Field of Search ..... 204/16, 180.1, 180.2, 204/180.7, 299 R

[56] References Cited

U.S. PATENT DOCUMENTS

| | | | |
|---|---|---|---|
| 2,283,206 | 5/1942 | Hayward | 204/180.2 |
| 3,398,071 | 8/1968 | Bagno | 204/130 |
| 3,523,844 | 8/1970 | Bagno | 156/52 |
| 3,766,040 | 10/1973 | Wellborn, Jr. | 204/180.1 |
| 4,107,026 | 8/1978 | Freeman | 204/300 R |
| 4,132,625 | 1/1979 | Peterson et al. | 204/299 R |
| 4,132,626 | 1/1979 | Kunkle | 204/301 |
| 4,443,312 | 4/1984 | Hennon | 204/180.2 |
| 4,543,525 | 9/1985 | Boryta et al. | 324/559 |
| 4,670,118 | 6/1987 | Klinkowski | 204/182.2 |
| 4,719,407 | 1/1988 | Converse et al. | 324/559 |
| 4,720,699 | 1/1988 | Owen | 341/13 |
| 4,725,785 | 2/1988 | Converse et al. | 324/559 |
| 4,740,757 | 4/1988 | Converse et al. | 324/559 |
| 4,751,467 | 6/1988 | Cooper | 324/557 |
| 4,751,841 | 6/1988 | Biard et al. | 73/49.2 |
| 4,755,757 | 7/1988 | Cooper | 324/557 |

*Primary Examiner*—John F. Niebling
*Assistant Examiner*—David G. Ryser
*Attorney, Agent, or Firm*—Gunn, Lee & Miller

[57] ABSTRACT

A system for sealing leaks in a nonconductive liner of a container of liquid or liquid-solid material. A voltage is impressed between an electrode in the material inside the container and an electrode in conductive material outside the liner. The system provides for a current path between these electrodes through any leaks that may exist in the liner. Solid particles suspended in the liquid in the impoundment accumulate at the leak as a result of electrophoresis, thereby sealing the leak. Although the system is especially useful for impounded waste materials, such as a landfill or surface impoundment, it may be used for many other types of containers.

22 Claims, 2 Drawing Sheets

ELECTROPHORETIC LEAK SEALING SYSTEM

FIELD OF THE INVENTION

This invention relates in general to a system for sealing leaks in any container having a nonconductive liner and having conductive liquid in the container and conductive material outside the container, such as water reservoirs, non-hazardous liquid containers, process tanks and vats, underground storage tanks, and inflexible wall containers, and in particular a system for containing liquid within a nonconductive liner in which leaks in the liner are sealed with electrophoretic particle motion.

RELATED PATENTS

U.S. Pat. Nos. 4,719,407, 4,725,785, 4,720,669, 4,751,841, 4,751,467, 4,755,757, 4,740,757, and Ser. No. 027,848 are all directed to various apparatuses and methods in connection with the use of synthetic membrane liners, also known as geomembrane liners and flexible membrane liners, to contain hazardous waste. More specifically, the inventions deal with electrical methods for detecting and locating leaks in the membrane liners.

BACKGROUND ART

1. Containing Fluid at Waste Sites

It is often desirable to have a liquid-proof barrier for containing a large body of liquid of liquid-containing material. For example, landfills and surface impoundments are two types of impoundments in which the fill volume may be hazardous wastes that contain toxic liquids. Some sort of barrier is necessary to prevent leakage that would contaminate the environment.

Membrane liners are one type of barrier often used for containing fluid waste. These liners are made from large sheets of flexible material such as plastic. In addition to being flexible, the liner material is selected to resist deterioration as a result of contact with the waste.

The liner is placed in a suitable excavated depression in the earth and is constructed to define the bottom and sides of the impoundment as an impermeable barrier. Generally, to form the liner, sheets of the material are seamed together at the site to form one or more continuous layers. In some installations, double liners are installed, with a layer of material such as sand between them.

One problem with such liners, however, is that installation practices and operational factors may lead to punctures or separated seams, and thus leaks in the liner. After hazardous waste has been introduced, such leaks are difficult to repair. Existing methods include draining the impoundment or using a cofferdam to access the leak, retrofitting the impoundment with a new liner, or applying a thick layer of sealant on the bottom. These repair methods may endanger workers and are generally unreliable and expensive.

The formation of a sealing layer over the impoundment liner is one means of inhibiting leakage if punctures exist. A slurry consisting of clay particles mixed with water is pumped into the impoundment. By the action of gravity, the clay particles fall toward the bottom of the impoundment to the top surface of the liner. This treatment is not always effective and the cost is prohibitive. The clay layer must be allowed to form over the entire liner because there is no means for selecting where a seal is to be made. At the bottom of the impoundment, this layer must be several centimeters thick to ensure an effective seal. Sealing the side walls of the impoundment is especially difficult because the particles tend to fall downward and the layer must be substantially thicker to protect against wave action and prevent the clay layer from sloughing to the bottom.

2. Applications of Electrophoresis

Electrophoresis can be described as an electrokinetic phenomenon that involves the motion of suspended solid particles through a stationary liquid under the influence of an applied electric field. Electrophoresis has been applied in various arts since the early part of this century.

One of the first practical uses of electrophoresis was electrophoretic coating of various materials. Examples are the use of aqueous emulsions for coating the inner surface of food cans with lacquers and the use of nonaqueous media for coating metals with resin.

It is well known that clay particles may carry an electrical charge and may be used as the particles in electrophoretic motion. This characteristic of clay particles has been applied to cake a mud fluid onto a porous well wall during drilling. Another application involves methods for de-watering clay suspensions so that the clay can be used for commercial purposes.

SUMMARY OF THE INVENTION

An object of the invention is to apply the electrophoresis effect to preferentially distribute charged particles so that they accumulate at a desired location on an otherwise nonconductive surface. A current is directed to the desired location so that the charged particles accumulate there rather than form a uniform layer on the surface.

Another object of the invention is to apply the electrophoresis effect so that charged particles migrate to a leak in a container sealed with a nonconductive liner.

Another object of the invention is to seal a leak in a nonconductive liner of a container by means of the accummulation of charged particles attracted to the leak.

Another object of the invention is to provide a means for sealing leaks in liners of containers using charged clay particles that are preferentially distributed using the electrophoresis effect.

Another object of the invention is to provide a means for sealing leaks in liners of containers that does not require draining of the liner.

Another object of the invention is to provide a means for sealing leaks in liners of containers in which control of the sealing action is remote from the site of the leak and no physical contact with the area of the leak is necessary.

SPECIFICATION

Figure 1:
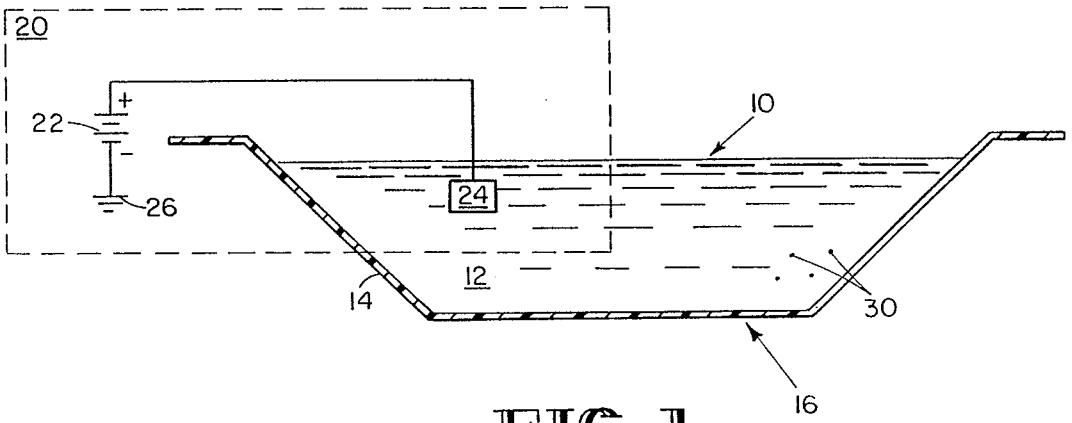
FIG. 1 is a sectional view of the leak sealing system used with a liquid waste impoundment, with the impoundment being defined by a liner in which there are no leaks.

FIG. 1 shows the leak sealing system, which has four basic components: a container, which in FIG. 1 is an impoundment 10, a means for impressing a voltage difference 20, sealing particles 30, and a means for creating a current path from the inside to the outside of the container. Although the system is especially useful for containing hazardous waste material, it is useful for any waste site having waste liquids that should not leak into the environment and that need not be kept pure, as well as for containment structures in general.

Impoundment 10 contains liquid or solid-liquid waste substances 12. Impoundment 10 may be as large as several acres and is usually rectangular in shape, although it may be any shape desired. It is more or less uniform in depth, although this too may be varied.

Impoundment 10 is defined by liner 14, which is made from any material that is electrically resistive, tends to be impermeable to liquid, and does not deteriorate from exposure to waste. Typically, liner 14 is made from sheets of flexible material, which are joined at their seams. In the preferred embodiment, liner 14 is a geomembrane liner made from impermeable plastics or rubbers. A 100-mil high-density polyethylene liner is an example. Other materials having a high electrical resistance may be used to form liner 14, which is constructed and placed on the bottom and sides of impoundment 10, and acts as an electrical insulator between the internal and external surfaces against it.

Figure 3:
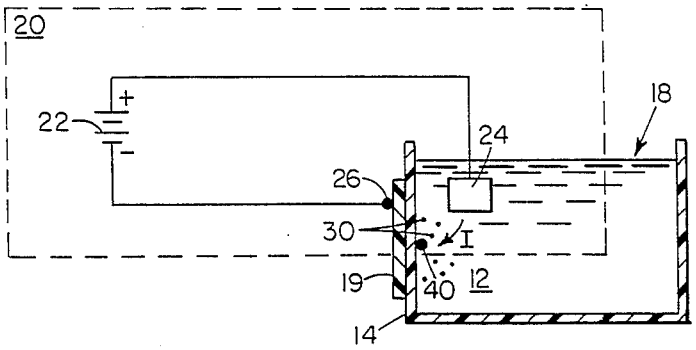
FIG. 3 is a sectional view of an alternative embodiment of the invention, used with a container, the container being defined by a nonconductive liner.
Figure 4:
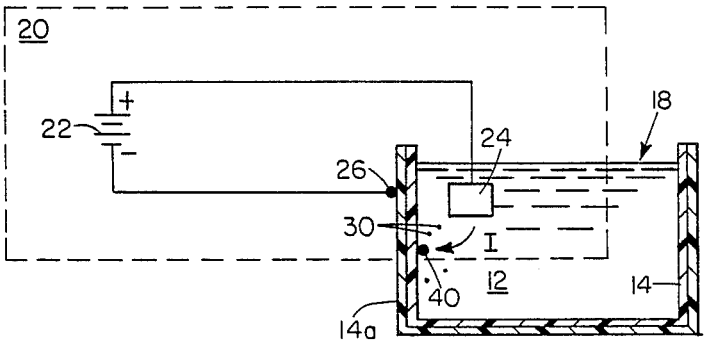
FIG. 4 is a sectional view of an alternative embodiment of the invention, used with a container having a nonconductive inner liner and a conductive outer liner.

In the preferred embodiment, Impoundment 10 may be located in any conductive medium 16, although as shown in FIG. 1, this media will typically be earth. In other embodiments of the invention, in which the container is not an impoundment or is not located in a conductive medium, other means for electrical conduction may be devised. For example, as shown in FIG. 3, if leak 40 in a container 18, which is not located in earth, is to be sealed, a conductive material 19 for receiving current I could be placed outside container 18 and connected to electrode 26. If the location of leak 40 is known, the current receiving conductor 19 can be placed outside the leak. Otherwise, the surface of current receiving conductor 19 can be enlarged or it can be moved to cover all potential leaks. In an alternative embodiment of the invention, as shown in FIG. 4, container 18 might have both a nonconductive liner 14 and a conductive outer surface 14*a*, which are leaking. Electrode 26 is electrically connected anywhere to outer surface 14*a*.

Referring again to FIG. 1, the means for impressing a voltage difference 20 may be as simple as a voltage source 22 and two electrodes 24 and 26. Voltage source 22 may be either at or remote to impoundment 10. Immersion electrode 24 and return electrode 26 are electrically connected to different terminals of voltage source 22. Typically, the voltage difference between the electrodes is about 100 volts.

Immersion electrode 24 is placed in liquid 12. Immersion electrode 24 may be placed anywhere in impoundment 10, although one of the advantages of the system is that physical contact with the fill of impoundment 10 is limited because immersion electrode 24 may be at the surface of impoundment 10. In the preferred embodiment, immersion electrode 24 is moveable through the fill volume of impoundment 10.

Return electrode 26 is placed in the conductive media outside the container, which in the embodiment shown in FIG. 1, is the earth outside impoundment 10. Ordinarily, return electrode 26 consists of a metal stake (not shown), which is driven into the earth in the vicinity of impoundment 10. Return electrode 26 is placed at a suitable depth so that there is a voltage difference across liner 14, from liquid 12 to the earth under liner 14. As described above, other embodiments require return electrode to be electrically connected to a conductor to receive current through leak 40.

As shown in FIG. 1, sealing particles 30 are suspended in liquid 12. Sealing particles 30 may be introduced into liquid 12, which may then disperse within liquid 12. The fill in impoundment 10 may affect the manner in which particles 30 are introduced. For example, if the fill volume is non-uniform, it may be necessary to introduce particles 30 at various locations or to introduce a slurry mixture containing particles 30.

The introduction of sealing particles 30 into liquid 12 results in a liquid-solid interface between the liquid 12 and sealing particles 30. Sealing particles 30 may be any type of electrically polarized material, such that, as a result of being dispersed in liquid 12, they acquire an electrical charge. This charge is a physical characteristic of the liquid-solid phase interface between liquid 12 and sealing particles 30. The phase interface creates an electrical double layer, in which positive charges are associated with one phase and negative charges are associated the other phase. The charges may be due to ions, electrons, or dipolar molecules.

In the preferred embodiment, the polarity of the impressed voltage is higher in liquid 12 than outside liner 14. Thus, in FIG. 1, the voltage is higher in impoundment 10 than in the earth.

Positive charges are associated with sealing particles 30, which are thus cations. These particles are fine particles of clay minerals in a colloidal suspension. The particles are sufficiently fine so that, if waste liquid can flow to a leak, the clay slurry can also flow to the leak, unhindered by any sludge that may exist on the liner. If necessary due to the type of substances in the impoundment, a thin layer of clay may be placed over the liner at the time of installation to increase the availability of clay particles to the leaks.

When sealing particles 30 are clay minerals, they carry a high surface charge because of certain characteristics of their molecular structure. Specifically, in clay particles, the molecules in the surface layer carry the charge because similar molecules exist on one side and dissimilar molecules on the other. Tests have shown that bentonite clay is a particularly effective material for sealing particles 30.

Although the preferred embodiment uses positively charged clay particles 30 which are attracted toward a negatively charged conductor outside liner 14, the polarity of electrodes 24 and 26 could be reversed. Particles 30 would then be required to carry a negative charge.

When there are no leaks in liner 14, liner 14 acts as an electrical insulator between the internal and external surfaces against it. The high resistivity of liner 14 inhibits current flow through liquid 12 between the immersion electrode 24 and return electrode 26. In the absence of any current in liquid 12, liquid 12 in the impoundment system 10 is exposed to a low and relatively constant field strength and there is no electrophoretic effect on particles 30.

Figure 2:
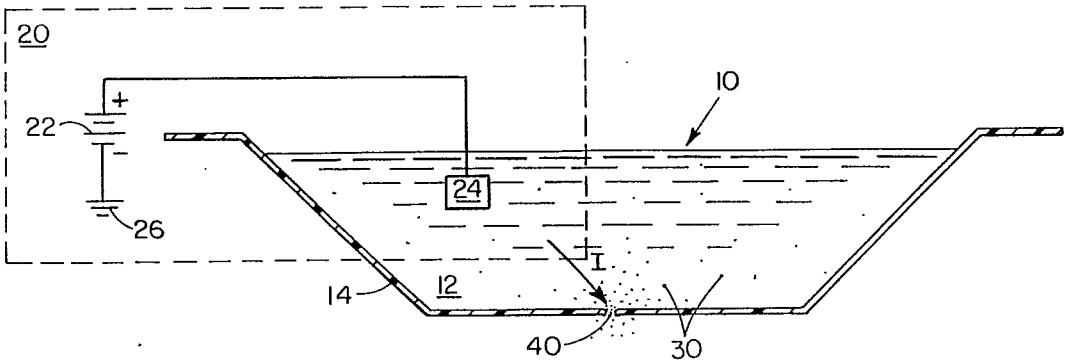
FIG. 2 is a sectional view of the leak sealing system shown in FIG. 1, with the liner having a leak.

FIG. 2 illustrates the system in operation for sealing a leak 40. The basic steps of the method are: lining an impoundment with a liner having properties of electrical resistivity and impermeability to liquid so that punctures in the liner provide a low-resistance path for electrical current, impressing a voltage difference on the impoundment, introducing sealing particles 30, and creating a current toward the leak 30 so that particles 30 accumulate there. These steps are explained in further detail below. Although this specification discusses the invention as used to seal a single leak, it should be understood that the same method will seal more than one leak simultaneously.

As shown in FIG. 2, as a result of any number of causes, liner 14 may become punctured or separated causing a leak 40. This leak allows liquid 12 to escape from impoundment 10 into the earth below liner 14. Because liquid 12 is conductive, as liquid 12 passes through leak 40, an electric current flows through leak 40. The current flow path is from voltage source 22, through immersion electrode 24, into through liquid 12, through leak 40, through the earth beneath liner 14, and to return electrode 26. The flow of fluid 12 through leak 40 establishes a shunt through liner 14, and the resulting current forms an electric field in which the current density is greatest at leak 40.

Typically, the resistance of liner 14 will be in the range of $1\times10^8$ ohms to $1\times10^{14}$ ohms and the resistance of the fill in impoundment 10 will be 10 ohms or less. Thus, in the vicinity of a leak, the current density crossing liner 14 when it has no leaks will be many orders of magnitude less than the current density at leak 40.

The electric field set up by the current flowing through leak 40 causes an electrophoretic effect, or the migration of sealing particles 30. This effect exists as long as the impressed voltage polarity is such that the particles 30 are of the opposite polarity.

Particles 30 follow the lines of the current flow and thus migrate toward leak 40. Particles 30 are thereby funneled to leak 40 in impoundment 10. Because of decreased mobility of particles 30 in the soil immediately under leak 40, particles 30 accumulate above and at leak 40. The effect of the accumulation of particles 30 is to seal leak 40.

Ideally, particles 30 are of a material that will create the most effective seal. For the preferred embodiment, particles 30 are of clay, which swell when wetted. For example, western sodium bentonite swells in water to approximately sixteen times its dry volume. The pressure of the swelling compresses the clay particles to form an impermeable barrier at leak 40.

The selection of materials to use for sealing particles 30 may depend on the materials impounded in impoundment 10. For example, the sealing qualities of bentonite clay may be altered when it is in contract with high levels of dissolved salts, acids, or alkalis. However, bentonite may be treated with polymers and specific organic non-toxic chemicals to improve its sealing capability. Also, in some applications, other sealing particles may be preferable to bentonite. Thus, sealing particles 30 may require selection or treatment according to the nature of the waste material in the impoundment.

In large impoundments or when multiple leaks exist, immersion electrode 24 may be selectively moved. Also, the leak sealing system may be designed so that immersion electrode 24 sweeps impoundment 10 to ensure maximum sealing effectiveness. It is also possible to combine immersion electrode 24 with a means for introducing sealing particles 30 into impoundment 10.

Voltage source 22 and electrodes 24 and 26 may or may not be permanently kept in place at the impoundment. Furthermore, the impressed voltage may or may not be continuous. If the impressed voltage is removed, sealing particles 30 can be expected to remain at leak 40 if there are no other forces acting on them. The leaks can be resealed if the impressed voltage is reestablished. Nevertheless, maintaining the impressed voltage at all times will maintain the optimum distribution of sealing particles 30 over liner 14.

Because liner 14 is nonconductive, the system's power requirements are minimized. Additionally, the flow of current through leak 40 may be monitored so that the progress of sealing, as well as the existence of leaks, may be monitored. These monitoring means are described in the various patents listed in the "Related Patents" section above.

The invention may also be used to seal leaks in impoundments having two liners with a conductive material, such as sand, in the inter-liner zone between the liners. The apparatus and method is essentially the same, except that return electrode 26 is placed in the inter-liner zone. Furthermore, the invention may be used in two-layer liners not having a conductive material in the inter-liner zone if the volume between the liners can be temporarily flooded with a conductive liquid such as water during the sealing process, with return electrode 26 being placed in that liquid.

Although the invention has been described with reference to specific embodiments, this description is not meant to be construed in a limiting sense. Various modifications of the disclosed embodiment, as well as alternative embodiments of the invention, will become apparent to persons skilled in the art upon reference to the description of the invention. It is therefore contemplated that the appended claims will cover such modifications that fall within the true scope of the invention.

We claim:

1. A method for electrophoretically sealing a leak in a thin-walled, non-conductive synthetic container, holding liquid or solid-liquid material, comprising the steps of:

impressing a voltage difference between said liquid or solid-liquid material and an area outside of said thin-walled, non-conductive synthetic container, introducing a dilute solution of sealing particles into said liquid or solid-liquid material in said thin-walled, non-conductive synthetic container, said sealing particles having properties such that they are electrically charged when suspended in said liquid or liquid-solid material, conducting a concentrated electrical current from said leak to an area outside said thin-walled, non-conductive synthetic container, and sealing said leak by drawing said sealing particles from said dilute solution to said leak by electrophoretic motion induced by said voltage difference.

2. The method claimed in claim 1 wherein said voltage impressing step comprises electrically connecting a voltage source to a first and a second electrode, electrically connecting said first electrode to said liquid or solid-liquid material in said thin-walled, non-conductive synthetic container, and electrically connecting said second electrode to said area outside said thin-walled, non-conductive synthetic container.

3. The method claimed in claim 1 wherein said step of conducting a concentrated electrical current comprises placing said thin-walled, non-conductive synthetic container in an electrically conductive medium.

4. The method claimed in claim 1 wherein said step of conducting a concentrated electrical current comprises placing an electrical conductor outside said thin-walled, non-conductive synthetic container and in contact with said leak.

5. The method claimed in claim 1 wherein said step of conducting a concentrated electrical current comprises placing a layer of electrically conductive material outside and in contact with said thin-walled, non-conductive synthetic container.

6. The method claimed in claim 1 wherein said sealing particles consist of clay minerals.

7. The method claimed in claim 6 wherein said sealing particles are bentonite clay.

8. A method for electrophoretically sealing a leak in a nonconductive synthetic liner of an impoundment located in the earth, which contains liquid or solid-liquid material, comprising the steps of:

impressing a voltage difference across said non-conductive synthetic liner, introducing a dilute solution of sealing particles into said liquid or solid liquid material in said impoundment, said sealing particles having properties such that they are electrically charged when suspended in said liquid or solid-liquid material, and sealing said leak by drawing said sealing particles from said dilute solution to said leak by electrophoretic motion induced by said voltage difference.

9. The method claimed in claim 8 wherein said step of impressing a voltage difference comprises electrically connecting a voltage source with a first and a second electrode, immersing said first electrode in said liquid or solid liquid material in said impoundment, and placing said second electrode in said earth.

10. The method claimed in claim 8 wherein said sealing particles consist of clay minerals.

11. The method claimed in claim 10 wherein said sealing particles are bentonite clay.

12. A system for electrophoretically sealing a leak in a thin-walled, non-conductive synthetic container, holding liquid or solid-liquid material, comprising:

a conducting means for receiving a concentrated electrical current from said leak to an area outside said thin-walled, non-conductive synthetic container, a voltage impressing means for creating a voltage difference between said liquid or solid-liquid material in said thin-walled, non-conductive synthetic container and said conducting means, and a dilute solution of sealing particles suspended in said liquid or solid-liquid material in said thin-walled, non-conductive synthetic container, said sealing particles having properties such that they are electrically charged when suspended in said liquid or solid-liquid material.

13. The system claimed in claim 12 wherein said voltage impressing means comprises a voltage source in electrical connection with a first and a second electrode, said first electrode immersed in said liquid or solid-liquid material in said thin-walled, non-conductive synthetic container and said second electrode electrically connected to said conducting means.

14. The system claimed in claim 12 wherein said conducting means is an electrically conductive medium in which said thin-walled, non-conductive synthetic container is located.

15. The system claimed in claim 12 wherein said conducting means is an electrical conductor, outside said thin-walled, non-conductive synthetic container and in contact with said leak.

16. The system claimed in claim 12 wherein said conducting means is a layer of electrically conductive material outside and in contact with said thin-walled, non-conductive synthetic container.

17. The system claimed in claim 12 wherein said sealing particles consist of clay minerals.

18. The system claimed in claim 17 wherein said sealing particles are bentonite clay.

19. A system for electrophoretically sealing a leak in a nonconductive synthetic liner of an impoundment located in the earth, which contains liquid or solid-liquid material, comprising:

a voltage impressing means for creating a voltage difference across said non-conductive synthetic liner, and a dilute solution of sealing particles suspended in said liquid or solid-liquid material in said impoundment, said sealing particles having properties such that they are electrically charged when suspended in said liquid or solid-liquid material.

20. The system claimed in claim 19 wherein said voltage impressing means comprises a voltage source in electrical connection with a first and a second electrode, said first electrode immersed in said liquid or solid-liquid material in said impoundment, and said second electrode placed in said earth.

21. The system claimed in claim 19 wherein said sealing particles consist of clay minerals.

22. The system claimed in claim 21 wherein said sealing particles are bentonite clay.

* * * * *